US006910492B1

(12) United States Patent
Stuck

(10) Patent No.: US 6,910,492 B1
(45) Date of Patent: Jun. 28, 2005

(54) ATV SUPPORTED SHELTER

(76) Inventor: Andrew G. Stuck, 1836 N. Mason St., Appleton, WI (US) 54913

( * ) Notice: Subject to any disclaimer, the term of this patent is extended or adjusted under 35 U.S.C. 154(b) by 203 days.

(21) Appl. No.: 10/215,851

(22) Filed: Aug. 9, 2002

(51) Int. Cl.[7] ..... E04H 15/06
(52) U.S. Cl. ..... 135/88.15; 135/88.16; 135/88.08; 135/88.09; 296/161; 296/77.1
(58) Field of Search ..... 135/88.07–88.09, 135/88.13, 88.14, 88.15, 133, 88.16, 88.1; 296/161–163, 296/136, 77.1, 136.02; 280/203

(56) References Cited

U.S. PATENT DOCUMENTS

| | | | | |
|---|---|---|---|---|
| 208,564 | A * | 10/1878 | Bowers | 296/110 |
| 2,689,579 | A * | 9/1954 | Sartori | 135/133 |
| 2,823,684 | A * | 2/1958 | Sartori | 135/136 |
| 2,826,210 | A * | 3/1958 | Heil | 135/132 |
| 3,995,649 | A * | 12/1976 | Robichaud | 135/133 |
| 5,058,943 | A * | 10/1991 | Louderback | 296/107.09 |
| 5,174,622 | A | 12/1992 | Gutta | |
| 5,297,844 | A | 3/1994 | Haustein | |
| 5,551,745 | A * | 9/1996 | Huang | 296/111 |
| 5,918,615 | A | 7/1999 | Stuck, Sr. | |
| 6,439,645 | B1 * | 8/2002 | Pedersen | 296/161 |

FOREIGN PATENT DOCUMENTS

GB 2066867 * 7/1981

OTHER PUBLICATIONS

"ATV Finshing Shelter" by ATVCABs. LLC. web site (www.atvcabs.com) Jun. 8, 2002 (5 pages).*

* cited by examiner

*Primary Examiner*—Winnie Yip
(74) *Attorney, Agent, or Firm*—Andrus, Sceales, Starke & Sawall, LLP

(57) ABSTRACT

A portable shelter includes at least one mounting plate fixedly secured to a support surface on opposite sides thereof. A wraparound attachment bracket is slidably connected on each of the mounting plates. A tubular framework assembly having a fabric covering attached thereto is swingably mounted on each attachment bracket between a collapsed, storage position and an extended, erect position adjacent the support surface. The support surface is preferably located on either an ATV or truck.

17 Claims, 10 Drawing Sheets

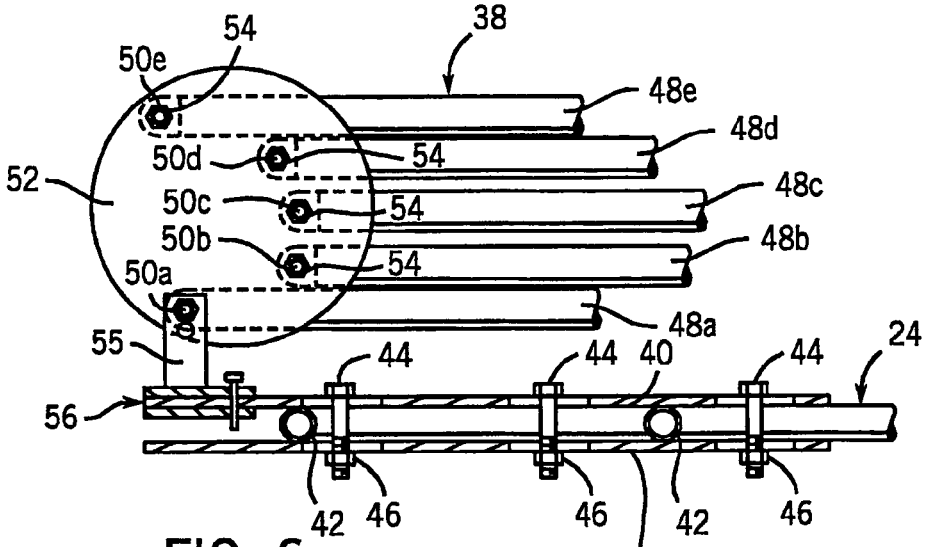
FIG. 6
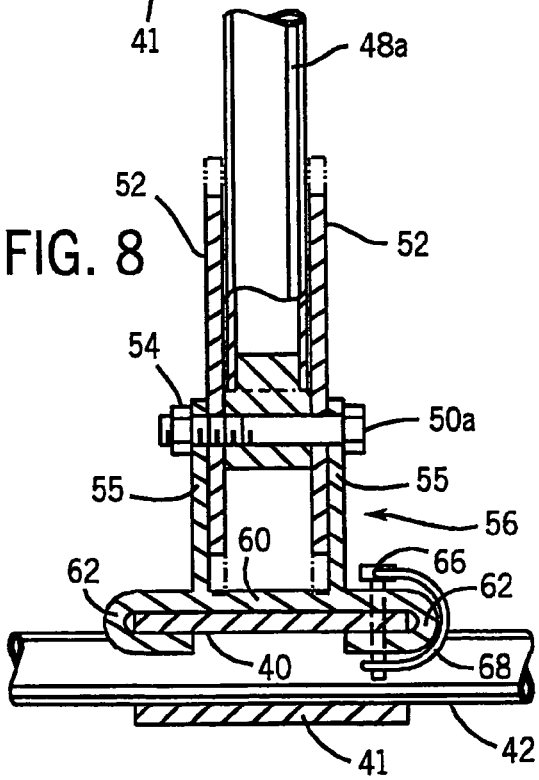
FIG. 8
FIG. 7
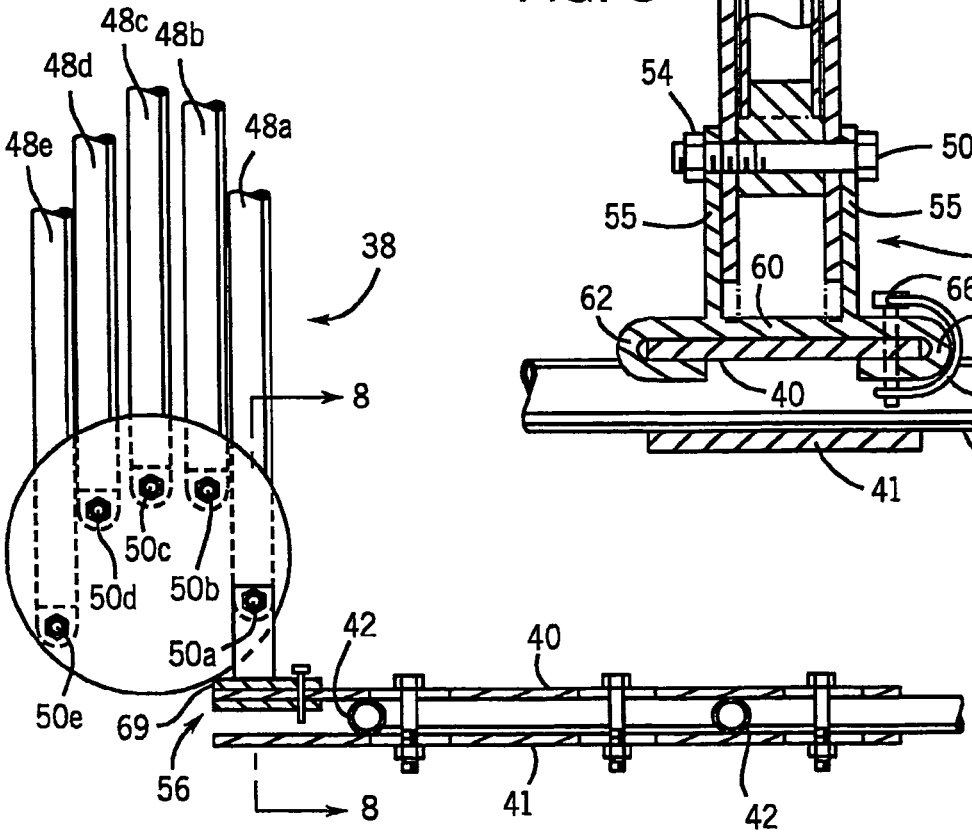

ATV SUPPORTED SHELTER

FIELD OF THE INVENTION

The present invention relates generally to a portable shelter which is movably mounted on a support surface and, more particularly, pertains to a collapsible and expandable shelter pivotally mounted to a support surface of an all terrain vehicle, truck or the like.

BACKGROUND OF THE INVENTION

All terrain vehicles (ATVs) have become increasingly popular in recent years as recreational vehicles, and are now also being recognized as utility vehicles. These ATVs are able to traverse all terrains including roadways, countryside hills and even mountain pathways. All terrain vehicles generally include two front and rear wheels with transmission and drive components connected to a centrally mounted motor to at least drive the rear wheels, and in some cases, all four wheels. A body shell covers a subframe of the vehicle and has a seat area straddling the motor. The body shell spreads laterally to define front and rear fenders at least partially covering the front and rear wheels. Typically, front and rear equipment carrying racks are disposed over front and rear portions of the body shell.

Sportsmen have quickly become aware of the utility of such ATVs to access woods, various bodies of water and other off road areas. Hunters, for example, use the ATV to travel into remote and roadless areas to increase the likelihood of locating game. Fishermen rely on the ATV to reach a desired site on a lake or stream, and often find it useful in ice fishing to pull an ice fishing shanty onto a frozen body of water.

Attempts have been made to equip ATVs with various removable enclosures. Examples of this are shown in U.S. Pat. No. 5,174,622 issued Dec. 29, 1992 to Gutta and U.S. Pat. No. 5,297,844 issued Mar. 29, 1994 to Haustein. The '844 patent discloses a rigid cab structure and folding hunting stand covered by a camouflaged material.

It is also known that ATV users and other sportsmen like to use a portable shelter in connection with their gaming activities. Such a shelter is disclosed in U.S. Pat. No. 5,918,615 issued Jul. 6, 1999 to Matthew A. Stuck, Sr.

The known prior art patents do not disclose a portable, collapsible and expandable shelter which is swingably connected to a support surface, for example, of the ATV such that, when expanded, the shelter lies fully erected adjacent the support surface. The known prior art patents also do not teach a mounting structure for movably connecting a portable foldable shelter to a support surface. The known prior art patents further do not disclose an ATV mounted portable shelter including a cover for enclosing the ATV when the shelter is fully erected adjacent the ATV.

Accordingly, it is desirable to provide a portable, foldable shelter movably adaptable to a variety of support surfaces, such as on an ATV, having the aforedescribed features absent from the known prior art.

SUMMARY OF THE INVENTION

It is a general object of the present invention to provide a portable shelter which may be quickly pivoted from a mounting arrangement into an erect position next to an ATV or truck.

It is also an object of the present invention to provide a support mounted portable shelter useful as a hunting blind or fishing shelter.

It is a further object of the present invention to provide a portable shelter having a collapsible framework assembly which is slidably mounted upon a support surface so that the framework assembly may be pivoted from a storage position to an operating position.

In one aspect of the invention, a portable shelter includes a support surface, and a tubular framework assembly having a fabric covering attached thereto. The tubular framework assembly is pivotally connected to the support surface between a collapsed, storage position and an extended, erect position adjacent the support surface. The tubular framework assembly is pivotally connected to the support surface by a mounting structure comprised of at least one mounting plate attached to the support surface, and an attachment bracket slidably mounted on the mounting plate. The tubular framework assembly includes a series of C-or U-shaped, telescopic tubes having right hand sides and left hand sides spaced from each other. The tubes on each side have ends pivotally mounted on bolts between a pair of circular mounting plates. The attachment bracket includes a pair of upstanding bars lying on the outside surfaces of the connecting plates, a flat portion overlying a top surface of the mounting plate and a pair of curled ends which wrap around outside edges of the mounting plate. One of the bolts is passed through the upstanding bars, the connecting plates and the end of one of the tubes to allow pivoting of the connecting plates and tubes relative to the attachment bracket. The attachment bracket is held on the mounting plate by means of a removable retainer pin. In its collapsed storage position, the tubular framework is carried in a zippered travel pouch. A spacing bracket may be interposed between the mounting plate and the attachment bracket. In the preferred embodiment, the support surface is located on an all terrain vehicle (ATV) or on a truck.

In another aspect of the invention, a portable shelter includes at least one mounting plate fixedly secured to a support surface on opposite sides thereof. A wrap around attachment bracket is slidably connected on each of the mounting plates. A tubular framework assembly has a fabric cover attached thereto. The tubular framework assembly is swingably mounted on each attachment bracket between a collapsed, storage position and an extended, erect position adjacent the support surface. The support surface is preferably located on front and rear carrying racks of an all terrain vehicle (ATV). The tubular framework assembly with its fabric covering are storable in a travel pouch carried by the ATV. An optional throw cover for the ATV is further storable in the travel pouch. The tubular framework assembly includes a series of telescopic tubes having ends pivotally mounted on bolts between a pair of circular connecting plates mounted on each mounting plate. Each pair of connecting plates is swingably mounted on one of the bolts about an axis substantially parallel to a longitudinal axis of the ATV. A pair of support straps extend between a rear panel of the fabric covering and the front and rear carrying racks. The rear panel of the fabric covering has vertical edges provided with zippers and hook and loop fasteners to enable opening and closing of the rear panel relative to the remainder of the fabric cover. The support surface may also be located on a tailgate of a truck. A support plate is interposed between the tailgate and a mounting plate at opposed ends of the tailgate.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is an enlarged, fragmentary detail view, partially in cross section, showing an arrangement for removably and pivotally mounting the collapsed framework assembly to a carrying rack of the ATV;

FIG. 7 is a view like FIG. 6 showing the collapsed framework assembly rotated 90 degrees upwardly;

FIG. 8 is a sectional view taken on line 8—8 of FIG. 7;

DETAILED DESCRIPTION OF THE INVENTION

Figure 1:
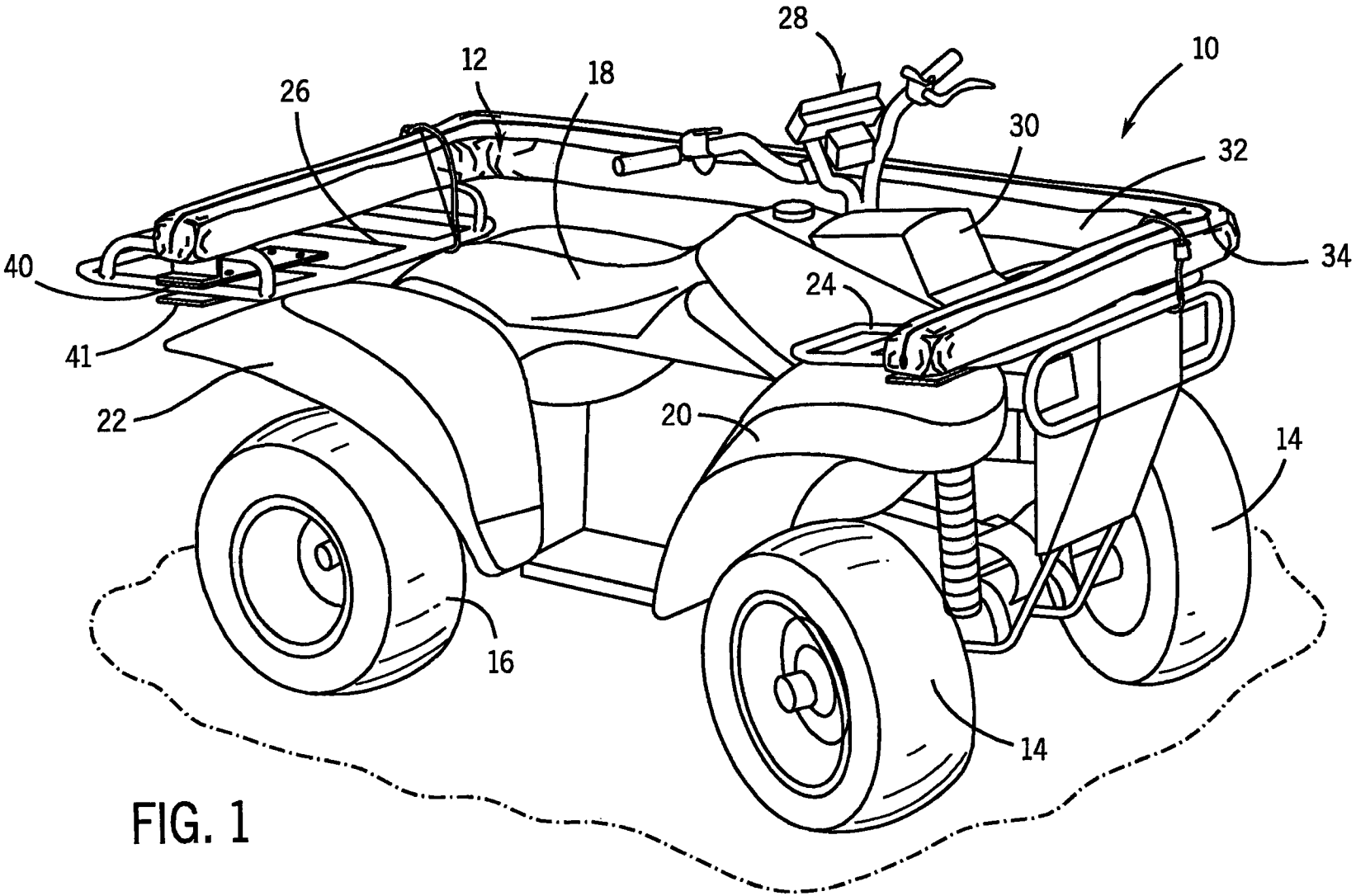
FIG. 1 is a front perspective view of an all terrain vehicle (ATV) mounted collapsible shelter embodying the present invention with the shelter being shown in a storage position.

Referring now to the drawings, FIG. 1 illustrates an all terrain vehicle (ATV) 10 equipped with a portable, collapsible and expandable shelter 12 (see also FIG. 2) mounted in accordance with the present invention. The ATV 10 shown is of the conventional four-wheeled type and represents either a two-wheel or four-wheel drive version. The ATV 10 includes a pair of front wheels 14 and a pair of rear wheels (one being seen at 16) between which are a motor (not shown) and a seat 18. The body of the ATV 10 flares out from respective front and rear decks to form front and rear fenders 20, 22, respectively, over which are mounted respective front and rear carrying racks 24, 26. A handle bar assembly 28 is located forwardly of the seat 18 and includes the normal steering, throttle, brake and other control means normal to that particular type of vehicle. A headlamp 30 is also typically mounted on the handle bar assembly to illuminate the driving path of the ATV 10 during darkness conditions. Front and rear carrying racks 24, 26 respectively, are a normal part of the ATV 10 and provide attachment points for the portable shelter 12.

Figure 2:
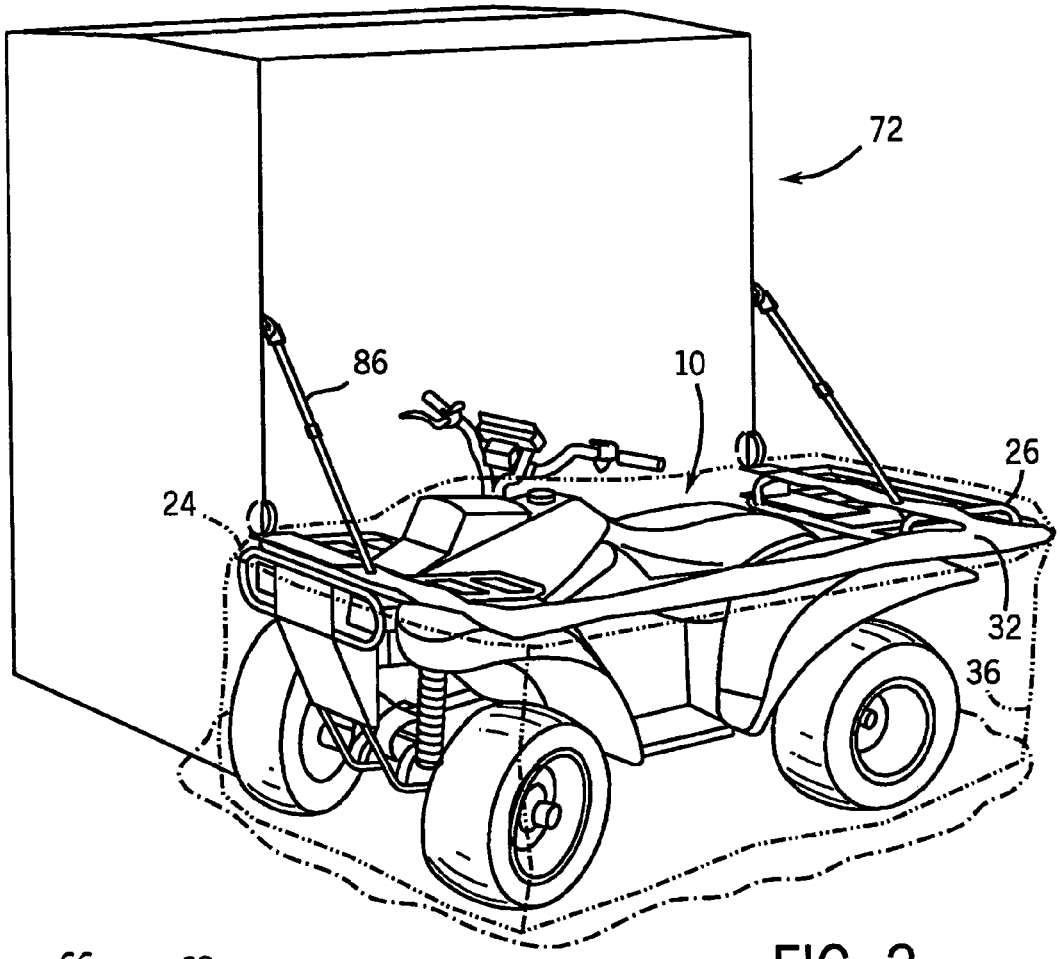
FIG. 2 is a rear perspective view of the collapsible shelter of FIG. 1 shown in an erected position supported by the ATV.

FIG. 1 illustrates the portable shelter 12 in a collapsed or folded, generally C- or U-shaped storage position encased within a travel pouch 32 having a zipper 34 running along the top side thereof. The positioning of the travel pouch 32 with its portable shelter within still allows the partial use of the carrying racks 24, 26 for guns, bows, storage boxes and the like. Although not shown, the travel pouch 32 can be held down on the ATV by bungee cords or the like. FIG. 2 shows a fully unfolded, extended or erected portable shelter mounted adjacent to and supported by the ATV 10, with the latter being enclosed by an optional throw cover 36 normally storable in the travel pouch 32. The shelter is erected to the side of the ATV 10 to keep dangerous gasoline fumes out of the shelter 12. The optional cover 36 helps to further conceal the smell of the gasoline fumes. In addition, because some ATVs 10 are brightly colored, the cover 36 cloaks the ATV 10 so that when the shelter 12 is used as a hunting blind, game animals will not be scared away by the colored ATV 10.

Figure 3:
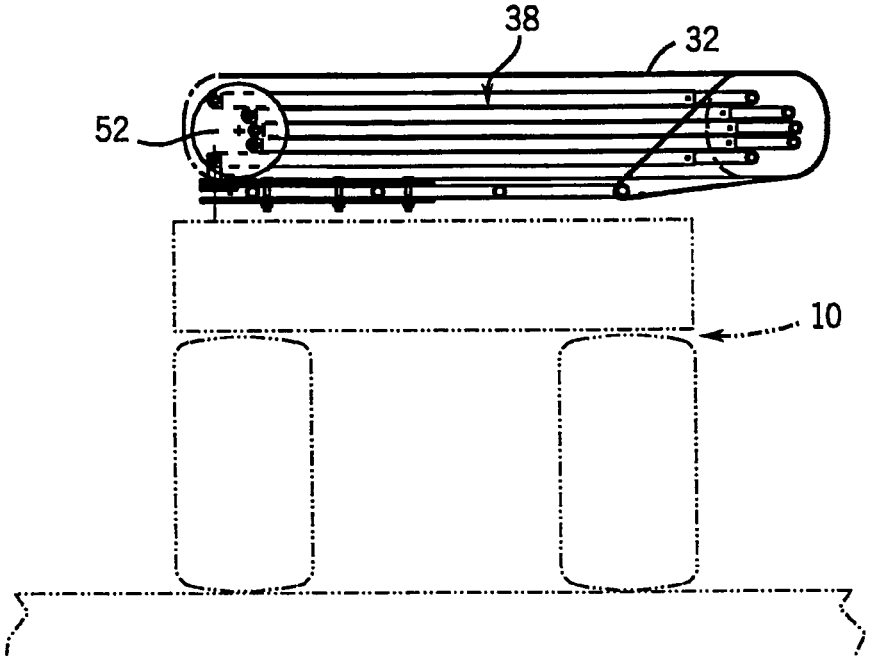
FIG. 3 is an end view showing the framework assembly of the collapsible shelter in the storage position within a travel pouch.

Referring now to FIG. 3, the portable shelter 12 encased within its travel pouch includes a collapsible framework assembly 38. When the travel pouch 32 is unzippered, the collapsible framework assembly 38 is unfolded and pivoted first to an initial position shown in FIG. 4 and then, without tools or fasteners, moved to a fully erect position shown in FIG. 5 to the side of the ATV 10.

As seen in FIGS. 1 and 6 through 8, a pair of generally rectangular upper and lower mounting plates 40, 41, respectively, are secured above and below the tubes 42 of both the front and rear carrying racks 24, 26 by bolts 44 and nuts 46. The collapsible framework assembly 38 is generally comprised of a series of five telescopic C- or U-shaped tubes 48*a–e*. The framework assembly 38 has one group of right hand ends pivotally mounted on respective bolts 50*a–e* between a pair of parallel connecting plates 52. The bolts 50*a–e* pass through the pair of connecting plates 52 and are held in place by respective nuts 54. As seen best in FIG. 8, the bolt 50*a* passes through a pair of upstanding bars 55 of an attachment bracket 56, the connecting plates 52 and the bottom end of tube 48*a*. It should be appreciated that the bolt holes in the connecting plates 52 are strategically positioned to allow the framework assembly 38 to unfold properly as will be described below. With this structure, tubular framework assembly 38 is pivotable about the axis of the bolt 50*a* which axis is substantially parallel to the longitudinal axis of the ATV 10.

Figure 9:
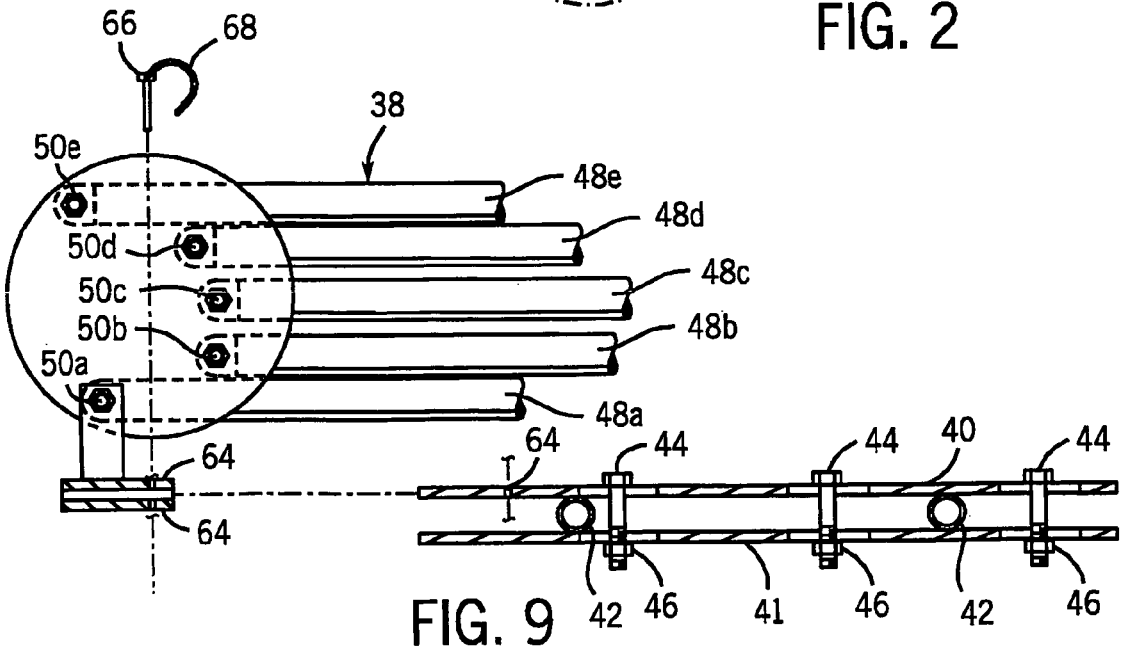
FIG. 9 is a view similar to FIG. 6, but showing the separation of the mounting and the collapsed framework assembly relative to the ATV carrying rack.

The attachment bracket 56 is integrally formed with a flat portion 60 having curled around ends 62 (FIG. 8) which are adapted to slide over the top surface and outer edges, respectively, of the upper mounting plate 40 on the front carrying rack 24. The upper mounting plate 40 is sufficiently spaced from the lower mounting plate 41 so that the attachment bracket 56 can be unobstructedly slidably mounted on the upper mounting plate 40. The upper mounting plate 40 and the attachment bracket 56 are formed with aligned holes 64 (FIG. 9) to receive a retaining pin 66. A keeper strap 68 is connected to the top of the retaining pin 66 so that when the retainer pin 66 is dropped through the aligned holes 64, the attachment bracket 56 is secured relative to the upper mounting plate 40 with the bottom of the strap 68 being connected to the bottom of the retainer pin 66 (FIG. 8). Together, the mounting plate 40 and the attachment bracket 56 define a mounting structure for the shelter 12.

Duplicate mounting structure is supplied for the left hand ends of the telescopic tubes 48*a–e* secured to the upper mounting plate 40 on the rear carrying rack 26.

Figure 4:
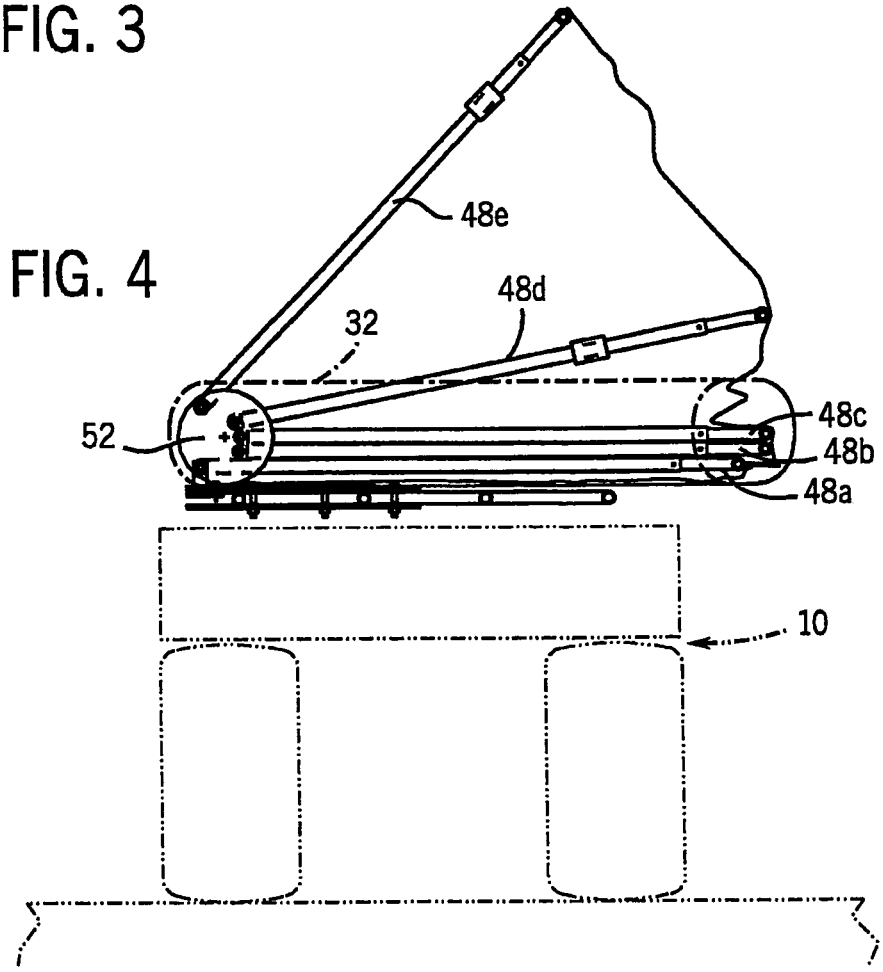
FIG. 4 is a view similar to FIG. 3, but showing the unfolding of the framework assembly of the collapsible shelter.
Figure 5:
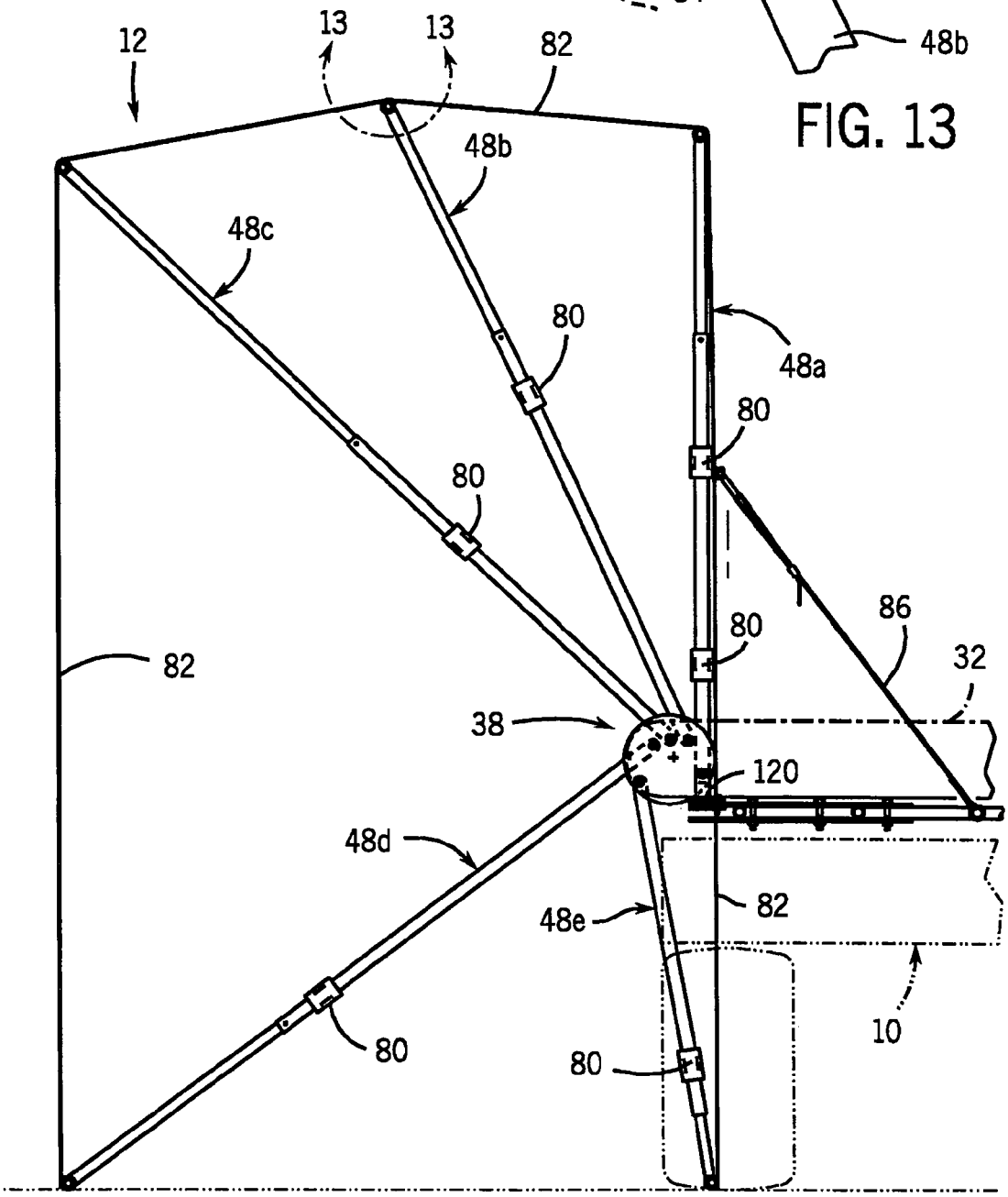
FIG. 5 is a view like FIG. 4 showing the framework assembly unfolded to the erect position.

It should be understood that the attachment brackets 56 are slidably mounted onto the upper mounting plates 40 attached to the front and rear carrying racks 24, 26 which serve as support surfaces. Once these connections are made, the front and rear connecting plates 52 may be pivoted about the bolts 50*a* so that the tubular framework assembly 38 is moved from horizontal position (FIG. 6) to a vertical position (FIGS. 7 and 8) at which point, contact is made between the connecting plates 52 and the top of the attachment bracket 56 at 69 (FIG. 7). Such contact enables the framework assembly 38 to be self-supporting. The first four tubes 48*b–e* may then be unfolded or pivoted about their bolts 50*b–e* as shown in FIG. 5 so as to erect the shelter 12 adjacent to the side of the ATV 10. Alternatively, all tubes 48*a–e* may be pivoted about their bolts 50*a–e* in a counterclockwise direction as shown in FIG. 4 in order to erect the shelter 12. The fifth tube 48*a* remains in an upright position when the shelter 12 is erected through the use of support straps to be described below.

Figure 13:
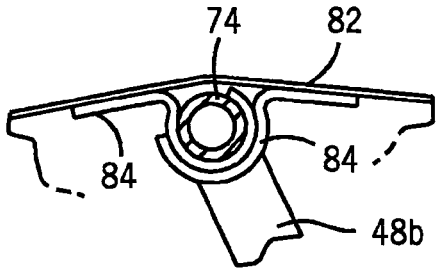
FIG. 13 is an enlarged sectional view taken on line 13—13 of FIG. 5.
Figure 12:
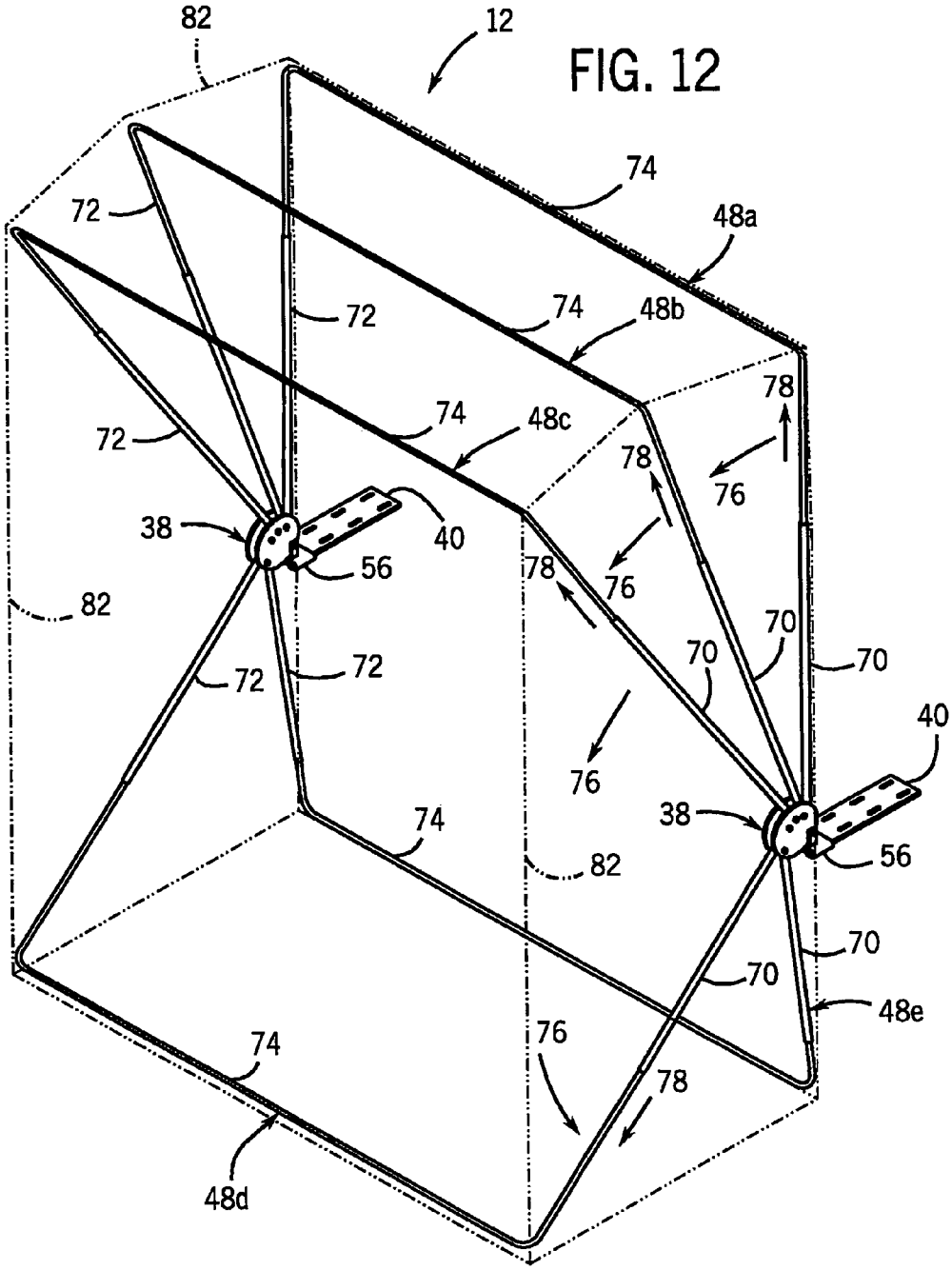
FIG. 12 is a front perspective view of an ATV supported collapsible framework assembly in the erect position.

As seen in FIG. 12, each C- or U-shaped tube 48*a–e* in the framework assembly 38 has a right hand section 70, a left hand section 72 and an intermediate section 74 which is telescopically mounted relative to the right hand and left hand sections 70, 72. The arrows 76 depict the unfolding motion of the tubes 48*a–e* while the arrows 78 represent the telescopic extension of the intermediate section 74 made possible by pushing a button on conventional release collars 80 (FIG. 5) supplied between ends of the intermediate section 74 and ends of the right and left hand section 70, 72 once the tubes 48*a–e* have been unfolded into its erect condition. A flexible fabric covering 82, such as canvas in a camouflage pattern, is attached to the tubes 48*a–e* along the top and sides thereof such as by hook and loop fasteners 84 which are sewn to the fabric covering 82 and attached to sections such as the intermediate sections 74 as shown in FIGS. 5 and 13. Once the shelter 12 is in the erect position, a pair of stabilizing support straps 86 (FIGS. 2 and 5) extend from the vertical tubes 48*a* and pass through the travel pouch 32 for attachment to the front and rear carrying racks 24, 26. As the covering 82 does not provide a floor for the shelter 12, the bottom is open for convenience such as for ice fishing.

Figure 14:
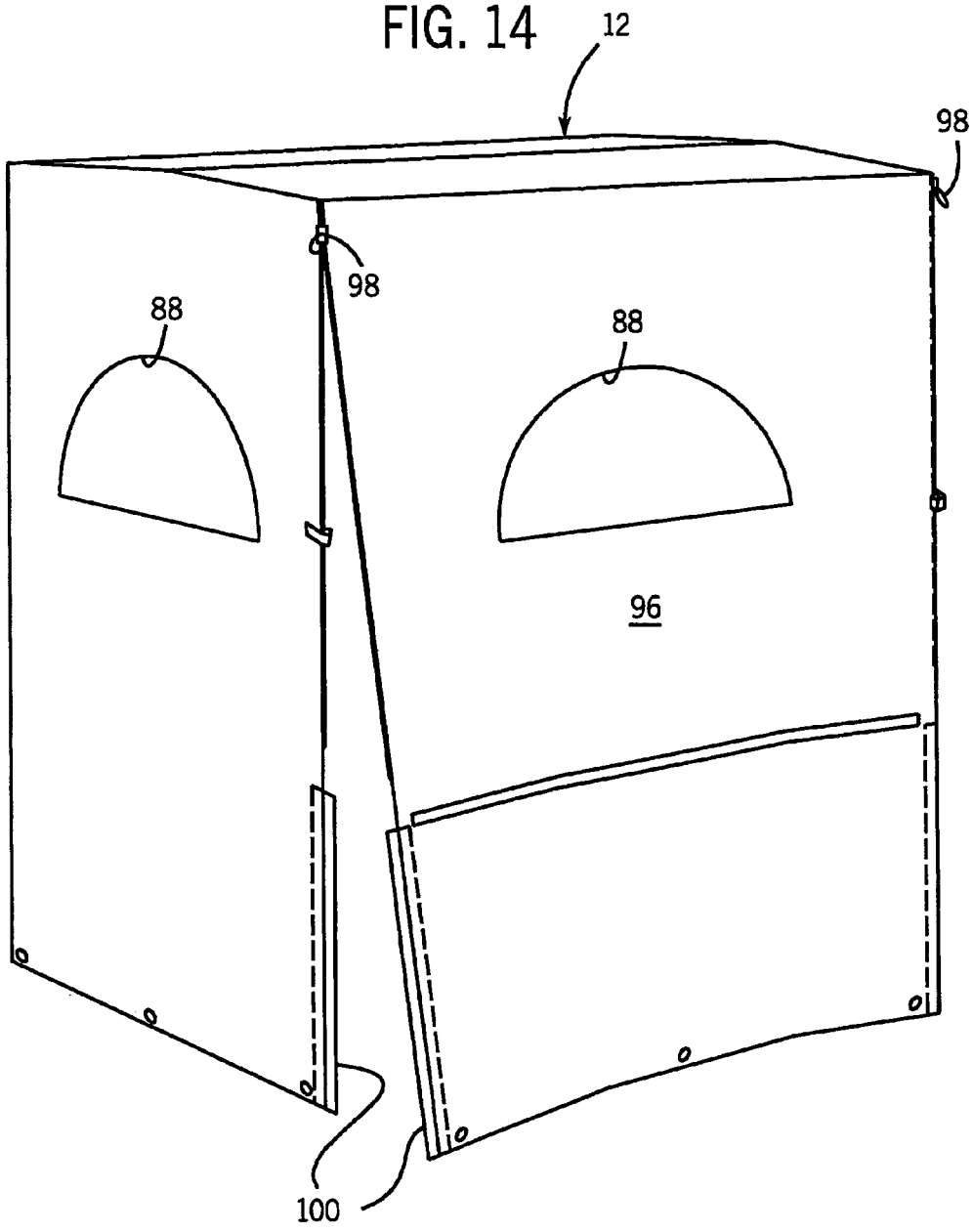
FIG. 14 is a rear perspective view of the collapsible shelter in the erect position showing a back panel of the shelter provided with zipper and hook and loop structure.
Figure 15:
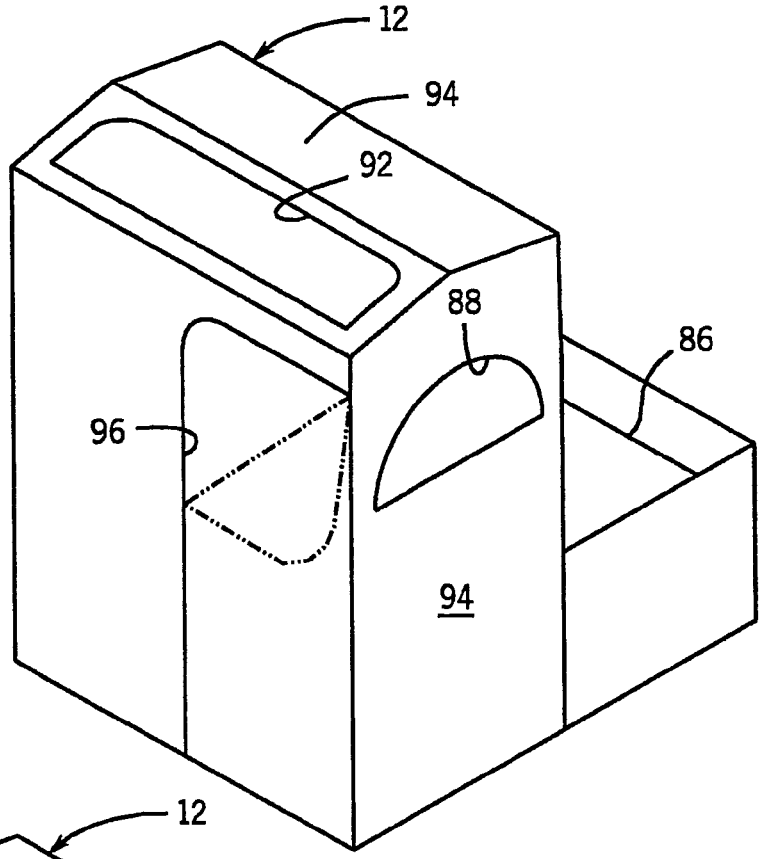
FIG. 15 is a front perspective view of the collapsible shelter in the erect position showing the shelter adapted for hunting and provided with an ATV cover.
Figure 16:
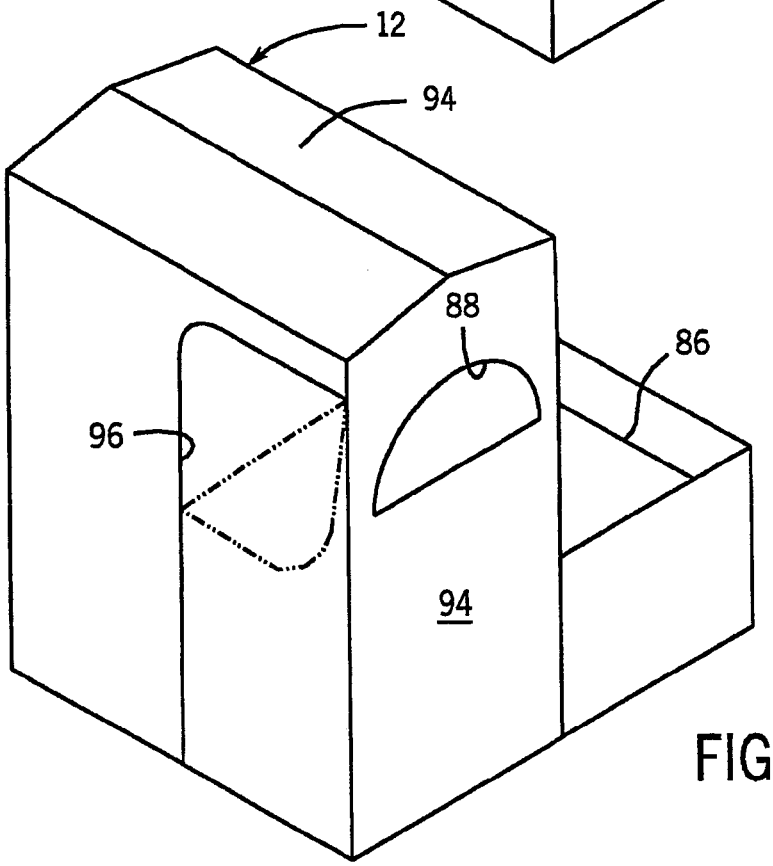
FIG. 16 is a front perspective view of the collapsible shelter in the erect position showing the shelter adapted for ice fishing and provided with an ATV cover.

The flexible fabric covering 82 may be designed as desired to include side windows 88 and doors 90 depending on the particular use. FIG. 15, for example, shows a hunting blind including gun ports 92 in the side and roof panels 94 of the shelter 12. FIG. 16, for example, shows an ice fishing shelter. FIG. 14 shows a rear panel 96 of an erected shelter 12 which can be selectively opened and closed by means of zippers 98 along the top extent thereof and by means of hook and loop fasteners 100 along the bottom extent thereof.

Figure 10:
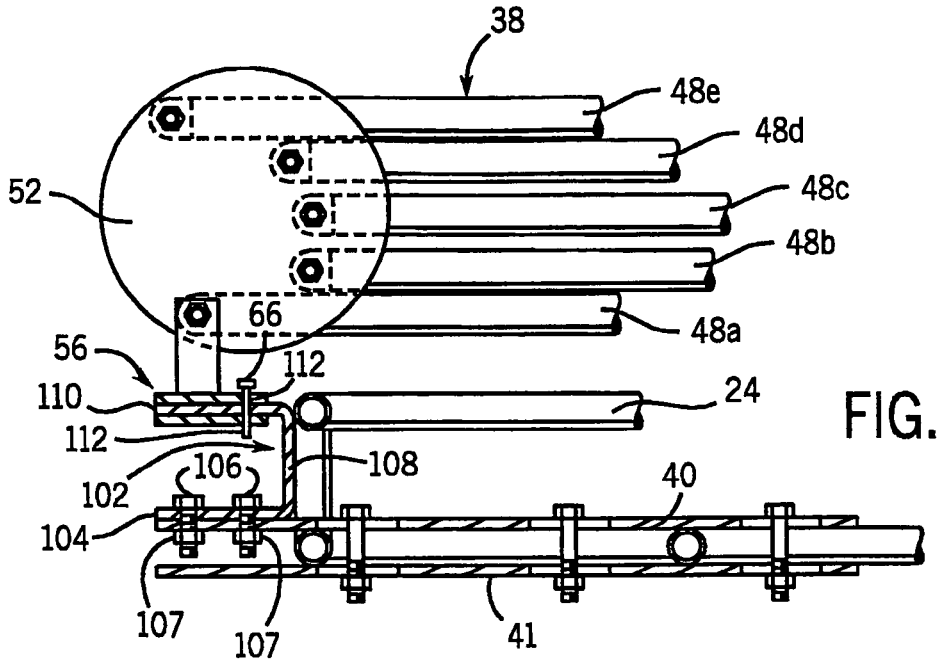
FIG. 10 is a view like FIG. 6, but showing the use of a spacer bracket between the mounting for the collapsed framework assembly and the ATV carrying rack.
Figure 11:
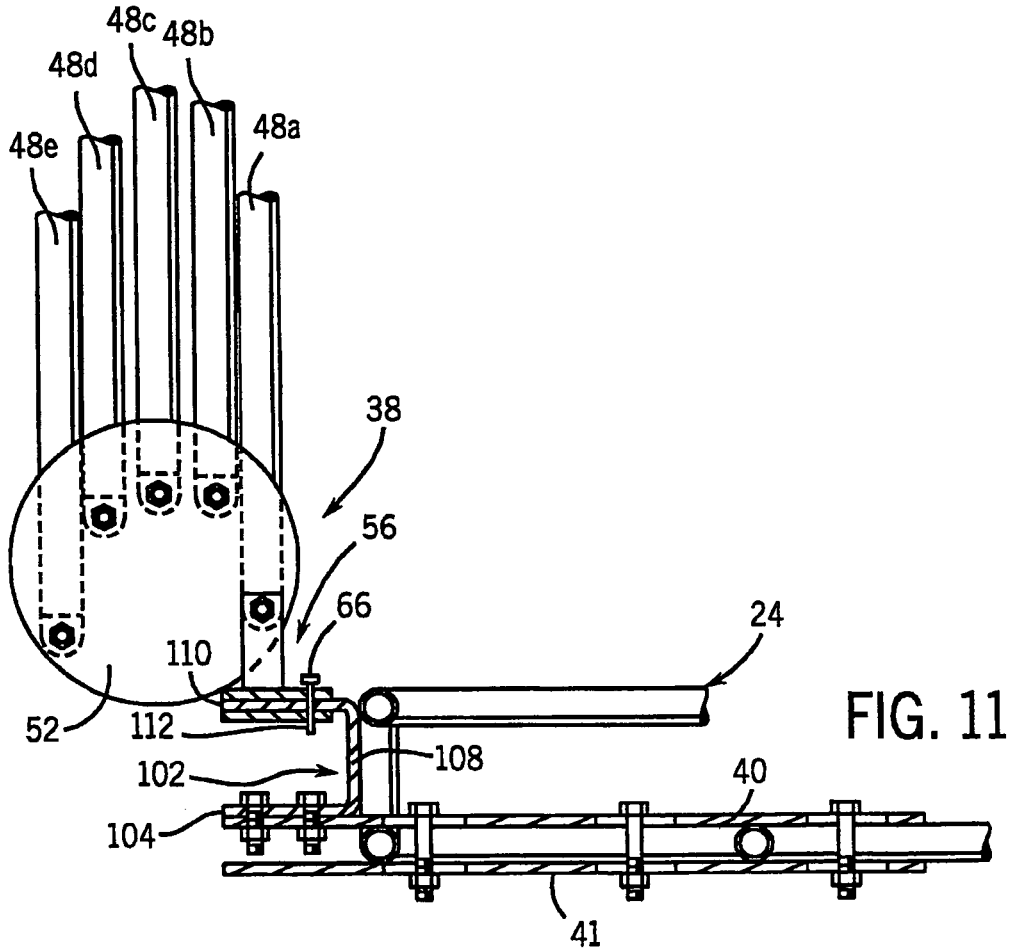
FIG. 11 is a view like FIG. 10, but showing the collapsible framework assembly being rotated 90 degrees upwardly.

FIGS. 10 and 11 show a mounting structure similar to FIGS. 6 and 7 except for a C-shaped spacing bracket 102 which may be used for varying carrying rack designs of the ATV 10. In this version, a bottom horizontal section 104 of the spacing bracket 102 is attached by bolts 106 and nuts 107 to the upper mounting plate 40. A vertical section 108 of the spacing bracket 102 extends the collapsible framework assembly 38 above the carrying rack 24 or 26. A top horizontal section 110 of the spacing bracket provides a mounting surface for the attachment bracket 56. Aligned holes 112 are provided in the attachment bracket 56 and the top horizontal section 110 of the spacing bracket 102 for the reception of retainer pin 66. The collapsible framework assembly 30 is supported by the spacing bracket 102 and operates identically as described previously with respect to the structure of FIGS. 6 and 7.

Figure 17:
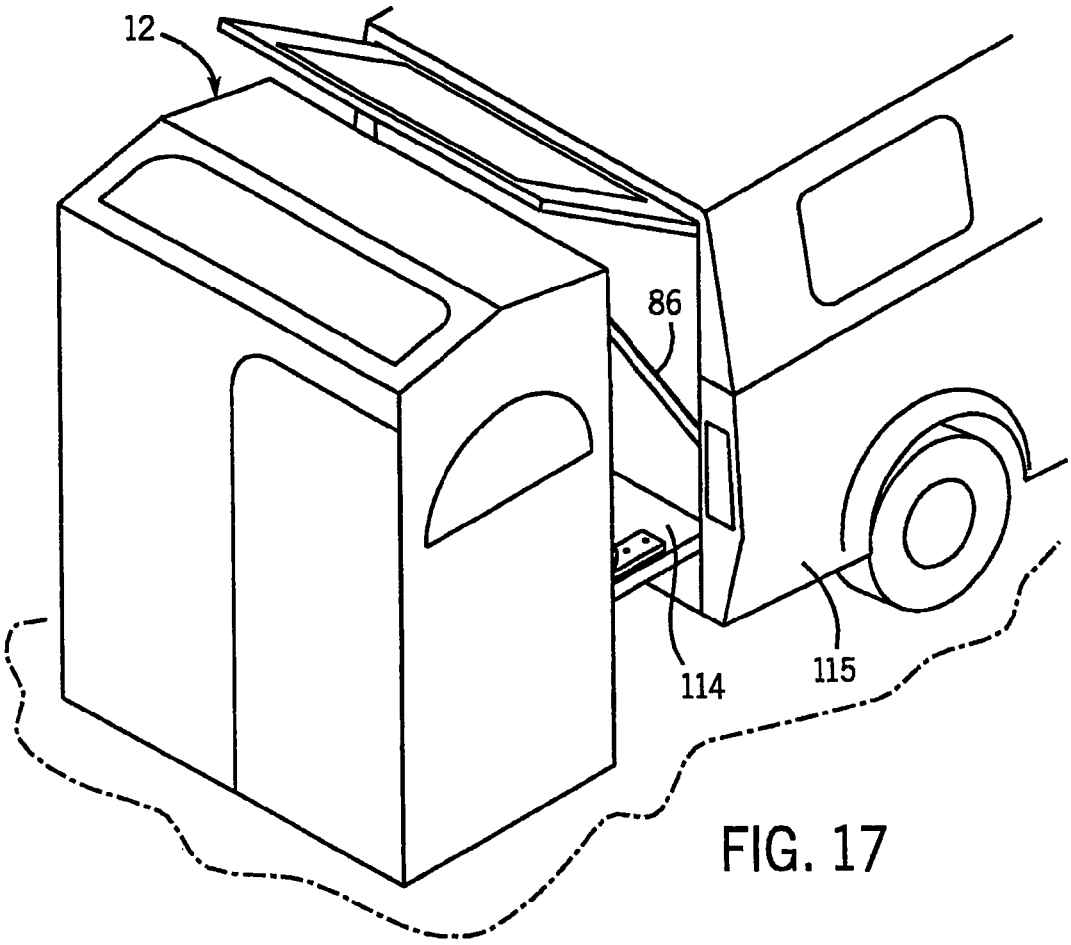
FIG. 17 is a perspective view of the collapsible shelter mounted on the tailgate of a truck and unfolded to the erect position.
Figure 18:
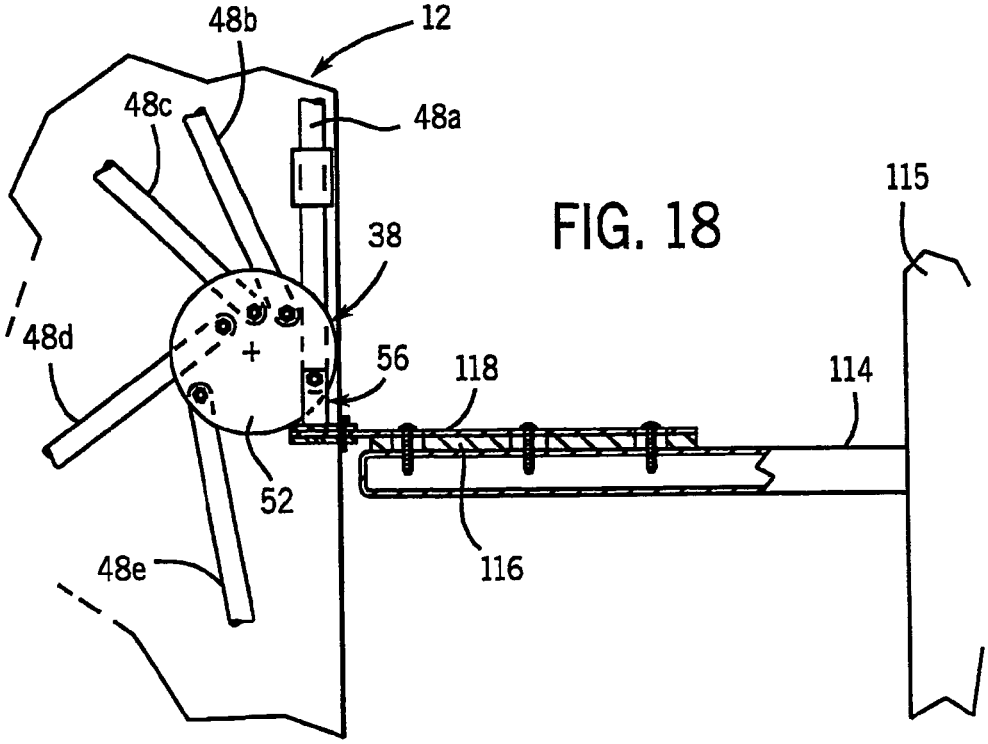
FIG. 18 is a view similar to FIG. 6 showing the mounting for the shelter illustrated in FIG. 17.

While the portable shelter 12 has been described as being supported on the ATV 10, it should be fully appreciated that the shelter 12 may also be mounted on other support surfaces such as from the lowered tailgate 114 of a truck 115. As seen in FIGS. 17 and 18, it is preferable to drill holes through the inside surface of the tailgate 114 on the right and left hand sides thereof. Once the holes have been drilled, a spacer plate 116 formed with openings aligned with the holes in the tailgate 114 is placed upon the tailgate 114 on the right and left hand sides thereof. Then, a base or mounting plate 118 formed with apertures in alignment with the drilled holes in the tailgate 114 and the openings in the spacer plate 116 is positioned to overly the spacer plate 116 on both sides of the tailgate 114. It is to be noted that the base plate 118 has a length which is longer than the spacer plate 116 so that the attachment bracket 56 may be received and secured on its outer end elevated above the inside surface of the tailgate 114.

In use of the preferred embodiment, the upper and lower mounting plates 40, 41 are bolted to the respective front and rear carrying racks 24, 26 of the ATV 10 making sure that there is a spacing of approximately 60 inches between the mounting plates 40, 41. Next, the travel pouch 32 zippered closed with the C- or U-shaped collapsible framework assembly 38 and the optional throw cover 36 inside is positioned as shown in FIG. 1 so that it lies about the periphery of the ATV 10. As mentioned previously, bungee cords (not shown) can be used to hold the travel pouch 32 down against the ATV 10. In this position, the bottom portion of the ends of the travel pouch 32 are provided with openings 120 (FIG. 5) so that the attachment bracket 56 can protrude therethrough for connection to the upper mounting plates 40 at the front and rear of the ATV 10. With the travel pouch 32 in place, the driver may access the ATV 10 from the right side thereof.

When it is desired to erect the portable shelter 10, the travel pouch 32 is unzippered and the tubes of the collapsible framework assembly 38 with its attached cover are quickly pivoted counterclockwise to the erect position shown in FIGS. 5 and 12. Once in the erect position, the user enters the shelter 12 and the intermediate sections 74 of the tubes 48*a–e* are telescoped outwardly by using the release collars 80. The user then exits the shelter 12 and attaches the support straps 86 to connection points on the vertical tubes 48*a* and the front and rear carrying racks 24, 26. As shown in FIGS. 2 and 5, the lower ends of the straps 86 pass through the travel pouch 32. Additionally, the user may access the travel pouch 32 to unveil the optional throw cover 36 over the ATV 10.

It should now be understood that the present invention provides a portable, collapsible shelter 12 which is pivotally mounted to a support surface. In the foregoing description, the support surfaces are embodied on an ATV 10 or truck 115, but it should be realized that the support surface may take other forms cooperable with the mounting structure set forth above. It should also be understood that, even without the support straps 86, the framework assembly 38 is self-supporting in that the connecting plates 52, when rotated about bolt 50*a*, contact the top of the attachment bracket 56.

The user may alternatively drill holes through the connecting plates 52 and tube 48*a* and pass a retainer through the aligned holes to self-support the framework assembly 38. Other means are contemplated to make the assembly 38 self-supporting. It should likewise be appreciated that the portable shelter 12 is quickly erected by one person from the collapsed or folded condition to the erect or extended position. The portable shelter 12 is shown for use as a hunting blind or fishing shelter, but can be used as a utility shelter, camping tent or other portable, collapsible enclosure.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A portable shelter comprising:

a support surface; and a tubular framework assembly having a fabric covering attached thereto, the tubular framework assembly being pivotally connected to the support surface between a collapsed, storage position and an extended, erect position adjacent the support surface, wherein the tubular framework assembly is pivotally connected to the support surface by a mounting structure comprised of at least one mounting plate attached to the support surface, and an attachment bracket slidably mounted on the mounting plate wherein the tubular framework assembly includes a series of C-shaped, telescopic tubes having right hand sides and left hand sides spaced from each other, the tubes on each side having ends pivotally mounted on bolts between a pair of circular connecting plates, and wherein the attachment bracket includes a pair of upstanding bars lying on outside surfaces of the connecting plates, a flat portion overlying a top surface of the mounting plate and a pair of curled ends which wrap around outside edges of the mounting plate, one of the bolts passing through the upstanding bars, the connecting plates and the end of one of the tubes to allow pivoting of the connecting plates and the tubes relative to the attachment bracket.

2. The portable shelter of claim 1, wherein pivoting of the connecting plates causes the connecting plates to contact the attachment bracket such that the tubular framework assembly is self-supported by the connecting plates.

3. The portable shelter of claim 1, wherein the attachment bracket is held on the mounting plate by means of a removable retainer pin.

4. The portable shelter of claim 1, wherein, in its collapsed storage position, the tubular framework is carried in a zippered travel pouch.

5. The portable shelter of claim 1, wherein a spacing bracket is interposed between the mounting plate and the attachment bracket.

6. The portable shelter of claim 1, wherein the support surface is located on an all terrain vehicle (ATV).

7. The portable shelter of claim 1, wherein the support structure is located on a truck.

8. A portable shelter comprising:

at least one mounting plate fixedly secured to a support surface on each of the opposite ends thereof;

an attachment bracket slidably connected on each of the mounting plates; and a tubular framework assembly having a fabric covering attached thereto, the tubular framework assembly having a series of telescopic tubes provided with ends secured between a pair of circular connecting plates swingably mounted on each attachment bracket between a collapsed, storage position and an extended, erect position adjacent the support surface, wherein the attachment bracket includes a pair of upstanding bars lying on outside surfaces of the connecting plates, a flat portion overlying a top surface of the mounting plate and a pair of curled ends which wrap around outside edges of the mounting plate, one of the bolts passing through the upstanding bars, the connecting plates and the end of one of the tubes to allow pivoting of the connecting plates and the tubes relative to the attachment bracket, the connecting plates being engageable with the attachment bracket such that the tubular framework assembly is self-supported by the connecting plates.

9. The portable shelter of claim 8, wherein the support surface is located on front and rear carrying racks of an all terrain vehicle (ATV).

10. The portable shelter of claim 9, wherein the tubular framework assembly with its fabric covering are storable in a travel pouch carried by the ATV.

11. The portable shelter of claim 10, wherein an optional throw cover for the ATV is further storable in the travel pouch.

12. The portable shelter of claim 10, wherein a pair of support straps extend between a rear panel of the fabric covering and the front and rear carrying racks.

13. The portable shelter of claim 12, wherein the rear panel of the fabric covering has vertical edges provided with zippers and hook and loop fasteners to enable opening and closing of the rear panel relative to the remainder of the fabric covering.

14. The portable shelter of claim 8, wherein each pair of connecting plates is swingably mounted on one of the bolts about an axis substantially parallel to a longitudinal axis of the ATV.

15. The portable shelter of claim 14, where each of the connecting plates has a series of holes formed therethrough including a first hole located substantially adjacent the periphery of the connecting plate for reception of one of the bolts, a second hole spaced opposite and located below the first hole and located substantially adjacent the periphery of the connecting plate, third and fourth holes located between and above the first and second holes and spaced inwardly from the periphery of the connecting plate and a fifth hole located between and above the first and second holes, and below the third and fourth holes, and spaced inwardly from the periphery of the connecting plate.

16. The portable shelter of claim 8, wherein the support surface is located on a tailgate of a truck.

17. The portable shelter of claim 16, wherein a support plate is interposed between the tailgate and the mounting plate at opposed ends of the tailgate.

* * * * *